US007003843B1

(12) United States Patent
Moore

(10) Patent No.: US 7,003,843 B1
(45) Date of Patent: Feb. 28, 2006

(54) GARBAGE CAN CLEANING SYSTEM

(76) Inventor: Mitchell Moore, 5710 18th St. W., Bradenton, FL (US) 34207

( * ) Notice: Subject to any disclaimer, the term of this patent is extended or adjusted under 35 U.S.C. 154(b) by 0 days.

(21) Appl. No.: 10/752,918

(22) Filed: Jan. 7, 2004

(51) Int. Cl.
*B08B 9/20* (2006.01)
*A47L 13/04* (2006.01)

(52) U.S. Cl. ..... 15/56; 15/70; 15/71; 15/24; 401/282

(58) Field of Classification Search ..... 15/56–59, 15/61, 65, 70–71, 73, 24, 75; 401/282, 284–285, 401/291, 137; 134/166 R, 169 R
See application file for complete search history.

(56) References Cited

U.S. PATENT DOCUMENTS 602,190 A * 4/1898 Evans ..... 15/75
1,217,597 A 2/1917 Hetch et al.
1,372,308 A 3/1921 Macrae
2,263,807 A * 11/1941 Hanson ..... 15/75
2,955,304 A * 10/1960 Noe ..... 15/75
4,614,449 A 9/1986 Kofgen et al.
5,709,003 A * 1/1998 Batch ..... 15/106
5,903,944 A * 5/1999 Burrell ..... 15/65
6,336,239 B1 * 1/2002 Cooper ..... 15/56
6,594,846 B1 * 7/2003 Scrivner ..... 15/88.3

* cited by examiner

*Primary Examiner*—John Kim
*Assistant Examiner*—Laura C Cole

(57) ABSTRACT

A garbage can cleaning system for cleaning a garbage can after garbage has been removed from the garbage can. The garbage can cleaning system includes a platform assembly being designed for being positioned on a vehicle, such as a flatbed trailer. The platform assembly is designed for storing fluid to be used for cleaning the garbage can. At least one fluid distribution assembly is coupled to the platform assembly. The fluid distribution assembly is designed for being in fluid communication with the fluid stored by the platform assembly whereby the fluid distribution assembly is for spraying the fluid into the garbage can to facilitate cleaning of the garbage can. At least one scrubbing assembly is coupled to the platform assembly. The scrubbing assembly is designed for scrubbing an interior of the garbage can to remove debris from the interior of the garbage can.

12 Claims, 2 Drawing Sheets

GARBAGE CAN CLEANING SYSTEM

BACKGROUND OF THE INVENTION

1. Field of the Invention

The present invention relates to cleaning brushes and more particularly pertains to a new garbage can cleaning system for cleaning a garbage can after garbage has been removed from the garbage can.

2. Description of the Prior Art

The use of cleaning brushes is known in the prior art. U.S. Pat. No. 1,372,308 describes a system for delivering water to an article and the brush rotates to clean the article. Another type of cleaning brush is U.S. Pat. No. 1,217,597 having a brush for dispensing water and soap onto a surface being cleaned. U.S. Pat. No. 4,614,449 having a brush, for cleaning such articles as bottles, that dispenses fluid from the brush to facilitate cleaning.

While these devices fulfill their respective, particular objectives and requirements, the need remains for a system that has certain improved features for collecting used fluid from a garbage can and storing the used fluid for proper disposal.

SUMMARY OF THE INVENTION

The present invention meets the needs presented above by providing a platform assembly that receives the used fluid and stores the used fluid and debris from the garbage can to be disposed of properly.

Still yet another object of the present invention is to provide a new garbage can cleaning system that provides a healthier environment by reducing the amount of contagions left behind in a garbage can.

To this end, the present invention generally comprises a platform assembly being designed for being positioned on a vehicle, such as a flatbed trailer. The platform assembly is designed for storing fluid to be used for cleaning the garbage can. At least one fluid distribution assembly is coupled to the platform assembly. The fluid distribution assembly is designed for being in fluid communication with the fluid stored by the platform assembly whereby the fluid distribution assembly is for spraying the fluid into the garbage can to facilitate cleaning of the garbage can. At least one scrubbing assembly is coupled to the platform assembly. The scrubbing assembly is designed for scrubbing an interior of the garbage can to remove debris from the interior of the garbage can.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
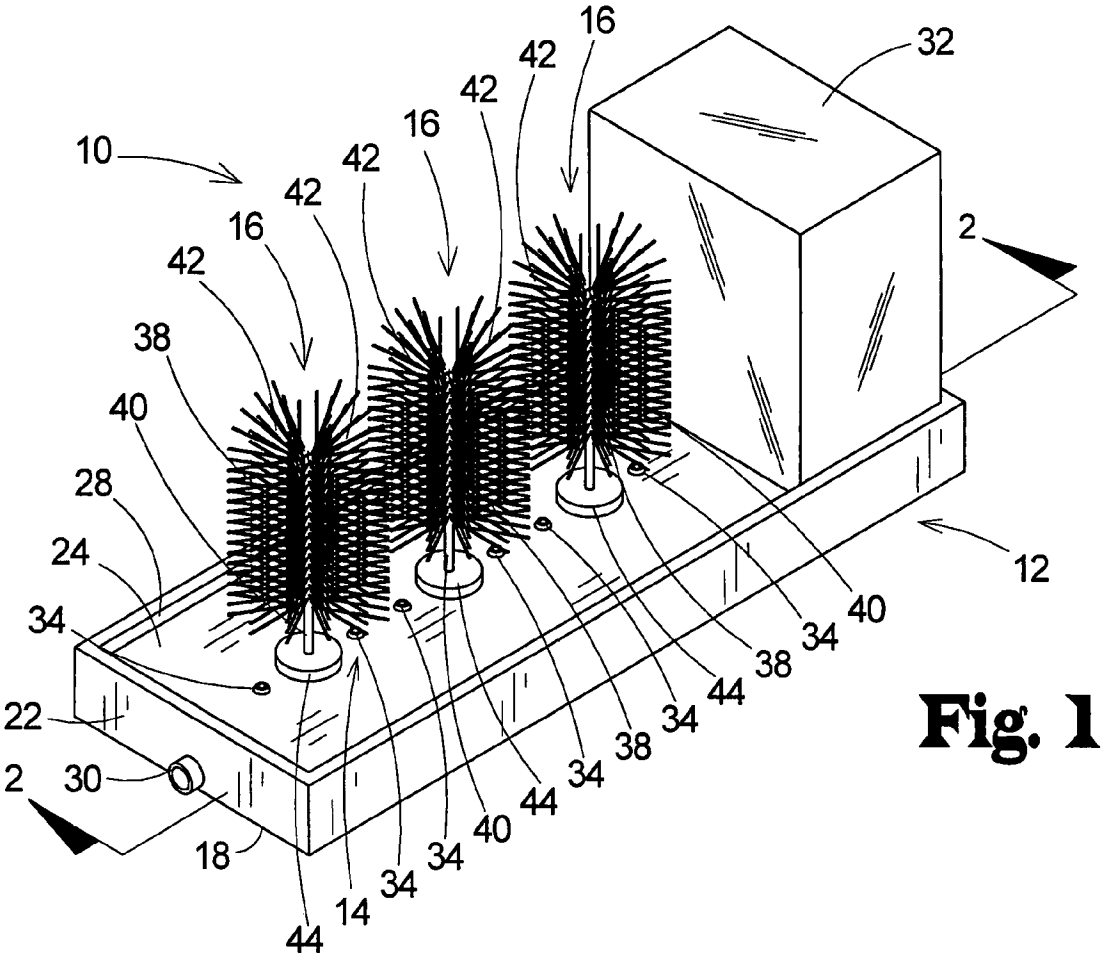
FIG. 1 is a perspective view of a new garbage can cleaning system according to the present invention.
Figure 2:
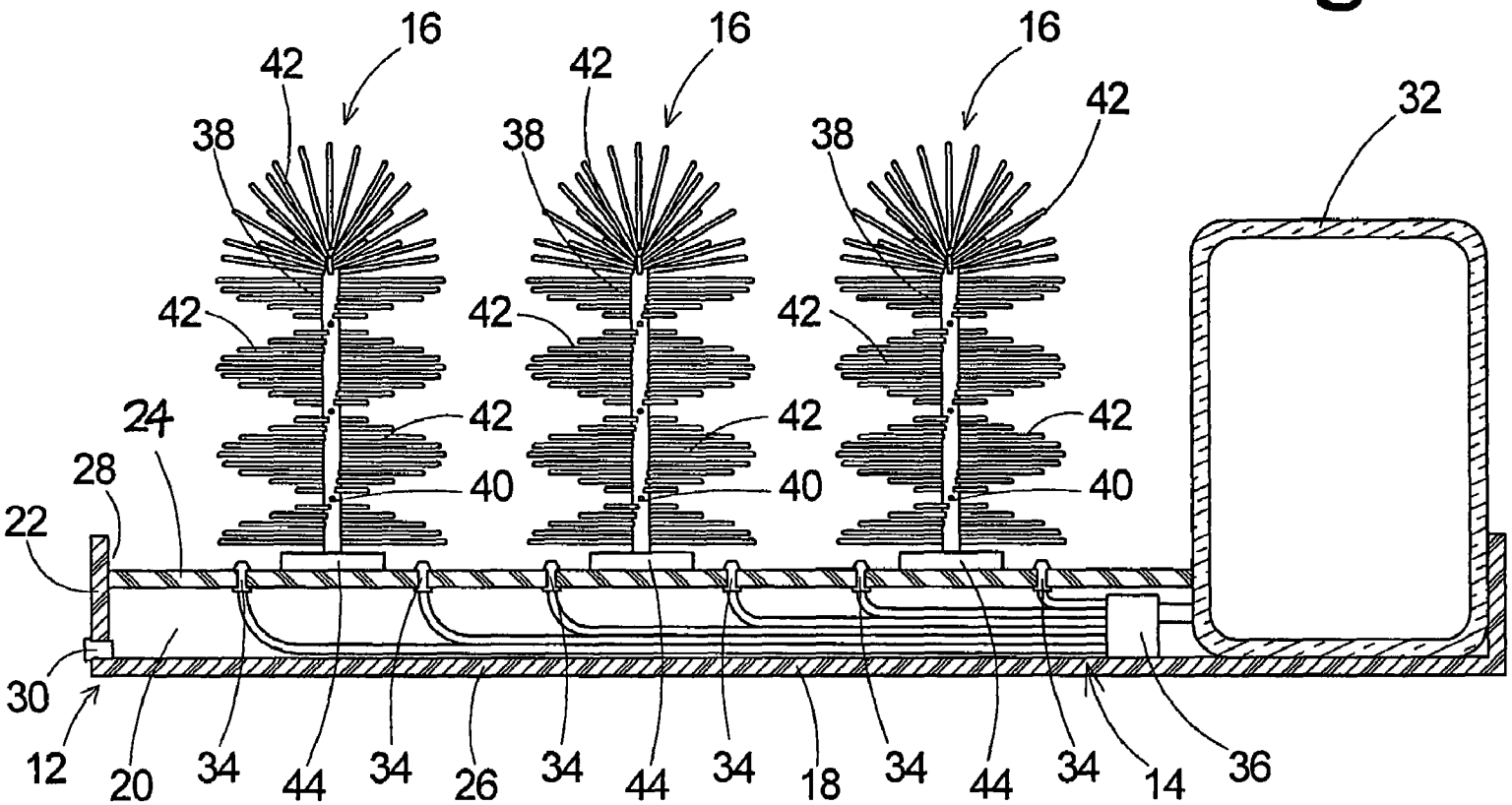
FIG. 2 is a cross-sectional view of the present invention taken along line 2—2 of FIG. 1.

With reference now to the drawings, and in particular to FIGS. 1 and 2 thereof, a new garbage can cleaning system embodying the principles and concepts of the present invention and generally designated by the reference numeral 10 will be described.

As best illustrated in FIGS. 1 and 2, the garbage can cleaning system 10 generally comprises a platform assembly 12 being designed for being positioned on a vehicle, such as a flatbed trailer. The platform assembly 12 is designed for storing fluid to be used for cleaning the garbage can.

At least one fluid distribution assembly 14 is coupled to the platform assembly 12. The fluid distribution assembly 14 is designed for being in fluid communication with the fluid stored by the platform assembly 12 whereby the fluid distribution assembly 14 is for spraying the fluid into the garbage can to facilitate cleaning of the garbage can.

At least one scrubbing assembly 16 is coupled to the platform assembly 12. The scrubbing assembly 16 is designed for scrubbing an interior of the garbage can to remove debris from the interior of the garbage can. Multiples of the scrubbing assembly 16 may be used to allow the user to clean several garbage cans at once.

The platform assembly 12 comprises a perimeter wall 18. The perimeter wall 18 defines an interior space 20 of the platform assembly 12. The interior space 20 of the platform assembly 12 is designed for receiving the fluid draining from the garbage can whereby the perimeter wall 18 of the platform assembly 12 is designed for containing the used fluid in the interior space 20 of the platform assembly 12 when the fluid distribution assembly 14 sprays fluid into the garbage can.

The perimeter wall 18 comprises a side wall 22, a top wall 24 and a bottom wall 26. The side wall 22 extends between the top wall 24 and the bottom wall 26 whereby the side wall 22 extends above the top wall 24 to define a lip 28 above the top wall 24. The lip 28 is designed to inhibit fluid and debris from the garbage cans from flowing off of the platform assembly 12 when the garbage can is being cleaned. The fluid is permitted to flow between a portion of the top wall 24 and the side wall 22 to allow the used fluid to enter the interior space 20 of the platform assembly 12.

The platform assembly 12 comprises a drainage aperture 30 extending through the perimeter wall 18 of the platform assembly 12. The drainage aperture 30 is in fluid communication with the interior space 20 of the platform assembly 12. The drainage aperture 30 is designed for permitting fluid collected in the interior space 20 of the platform assembly 12 to be selectively drained out of the interior space 20 of the platform assembly 12.

The platform assembly 12 comprises a tank member 32. The tank member 32 is coupled to the perimeter wall 18 of the platform assembly 12. The tank member 32 is designed for storing fluid to be used for cleaning the garbage can. The tank member 32 is in fluid communication with the fluid distribution assembly 14 whereby the fluid distribution assembly 14 is designed for spraying fluid from the tank member 32 into the garbage can.

The fluid distribution assembly 14 comprises at least one nozzle member 34. The nozzle member 34 is coupled to the platform assembly 12 whereby the nozzle member 34 is positioned proximate the scrubbing assembly 16. The nozzle member 34 is in fluid communication with the tank member 32 of the platform assembly 12 whereby the nozzle member 34 is for spraying the fluid from the tank member 32 into the garbage can when the scrubbing assembly 16 is scrubbing the interior of the garbage can.

The fluid distribution assembly 14 comprises a pump assembly 36. The pump assembly 36 is coupled to the platform assembly 12 whereby the pump assembly 36 is in fluid communication with the tank member 32 of the platform assembly 12. The pump assembly 36 is operationally coupled to the nozzle member 34 whereby the pump assembly 36 is for pressurizing the fluid from the tank member 32 and transferring the fluid to the nozzle member 34 to be sprayed into the garbage can.

The scrubbing assembly 16 comprises a brush member 38. The brush member 38 is coupled to the platform assembly 12 whereby the brush member 38 extends upwardly from the platform assembly 12. The brush member 38 is designed for being inserted into the interior of the garbage can when the garbage can is turn upside down and positioned over the brush member 38 to allow debris and fluid from the interior to drain onto the platform assembly 12. The brush member 38 is designed for brushing against the interior of the garbage can to clean the interior of the garbage can.

The brush member 38 of the scrubbing assembly 16 comprises a rod portion 40 and a plurality of bristle portions 42. The rod portion 40 is coupled to the platform assembly 12 whereby the rod portion 40 extends upwardly from the platform assembly 12. The bristle portions 42 are coupled to the rod portion 40 whereby the bristle portions 42 radially extend from the rod portion 40. The bristle portions 42 are designed for brushing against the interior of the garbage can to clean debris from the interior of the garbage can. Each of the bristle portions 42 of the brush member 38 comprises a flexible material. The flexible material of the bristle portions 42 is designed for permitting the bristle portions 42 to conform to a shape of the garbage can to provide the greatest amount of cleaning area.

The scrubbing assembly 16 comprises a motor assembly 44. The motor assembly 44 is operationally coupled between the brush member 38 of the scrubbing assembly 16 and the platform assembly 12. The motor assembly 44 is for rotating the brush member 38 whereby the brush member 38 is rotated in the interior of the garbage can to facilitate cleaning of the interior of the garbage can.

In use, the platform assembly 12 is mounted to a vehicle. The tank member 32 of the platform assembly 12 is filled with the fluid to be used for cleaning the garbage can. The vehicle follows a garbage truck and as the garbage can is emptied of trash the user takes the garbage can and places the garbage can over the brush member 38. The motor assembly 44 is actuated by the user to rotate the brush member 38 inside the garbage can to scrub the interior of the garbage can. The user actuates the pump assembly 36 to pump fluid from the tank member 32 to the nozzle member 34 to be sprayed into the garbage can to further facilitate cleaning of the interior of the garbage can. The fluid and debris draining from the garbage can are collected on the platform assembly 12 and drain into the interior space 20 of the platform assembly 12 to be stored for disposal. The user actuates the motor assembly 44 to discontinue spinning the brush member 38 and actuates the pump assembly 36 to discontinue spraying of fluid from the nozzle member 34. The garbage can is then removed from the brush member 38 and upright on the ground to allow the garbage can to dry. The user then use the drain aperture to drain the fluid and debris collected in the interior space 20 of the platform assembly 12 when the user has finished with the route.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garbage can cleaning system for cleaning the interior of a garbage can, the garbage can cleaning system comprising:

a platform assembly being adapted for being positioned on a vehicle, said platform assembly defining a reservoir for storing fluid to be used for cleaning the garbage can, said platform assembly having an upper surface on which the garbage can to be cleaned is rested during cleaning;

at least one fluid distribution assembly being coupled to said platform assembly, said fluid distribution assembly being adapted for being in fluid communication with the fluid stored by said platform assembly such that said fluid distribution assembly is for spraying the fluid into the garbage can to facilitate cleaning of the garbage can;

at least one scrubbing assembly being coupled to said platform assembly, said scrubbing assembly being adapted for scrubbing an interior of the garbage can to remove debris from the interior of the garbage can; and said fluid distribution assembly comprising at least one nozzle member, said at least one nozzle member being coupled to said platform assembly, said at least one nozzle member being positioned proximate said scrubbing assembly, said at least one nozzle member being in fluid communication with the reservoir defined by said platform assembly such that said at least one nozzle member is capable of spraying the fluid from the reservoir into the garbage can when said scrubbing assembly is scrubbing the interior of the garbage can;

said at least one nozzle member being positioned on said platform assembly such that fluid exits said at least one nozzle substantially at the upper surface of said platform assembly;

said at least one nozzle member being oriented on said platform assembly such that fluid exiting said at least one nozzle member flows in a substantially orthogonal direction with respect to the upper surface of said platform assembly to direct fluid upwardly towards a bottom of the garbage can when said scrubbing assembly is positioned in the interior of the garbage can; said platform assembly comprising a tank member forming said reservoir, said tank member being adapted for storing fluid to be used for cleaning the garbage can, the tank member being in fluid communication with the fluid distribution assembly such that said fluid distribution assembly is adapted for spraying fluid from the tank member into the garbage can.

2. The garbage can cleaning system as set forth in claim 1, further comprising:

said platform assembly comprising a perimeter wall, said perimeter wall defining an interior space of said platform assembly, said interior space of said platform assembly being adapted for receiving the fluid draining from the garbage can such that said perimeter wall of said platform assembly is adapted for containing the used fluid in said interior space of said platform assembly when said fluid distribution assembly sprays fluid into the garbage can.

3. The garbage can cleaning system as set forth in claim 2, further comprising:

said platform assembly comprising a drainage aperture extending through said perimeter wall of said platform assembly, said drainage aperture being in fluid communication with said interior space of said platform assembly, said drainage aperture being adapted for permitting fluid collected in said interior space of said platform assembly to be selectively drained out of said interior space of said platform assembly.

4. The garbage can cleaning system as set forth in claim 2, further comprising:

said tank member being coupled to said perimeter wall of said platform assembly.

5. The garbage can cleaning system as set forth in claim 1, further comprising:

said fluid distribution assembly comprising a pump assembly, said pump assembly being coupled to said platform assembly such that said pump assembly is in fluid communication with the fluid being stored by said platform assembly, said pump assembly being operationally coupled to said nozzle member such that said pump assembly is for pressurizing the fluid and transferring the fluid to said nozzle member to be sprayed into the garbage can.

6. The garbage can cleaning system as set forth in claim 1, further comprising:

said scrubbing assembly comprising a brush member, said brush member being coupled to said platform assembly such that said brush member extends upwardly from said platform assembly, said brush member being adapted for being inserted into the interior of the garbage can when the garbage can is turn upside down and positioned over the brush member to allow debris and fluid from the interior to drain onto the platform assembly, said brush member being adapted for brushing against the interior of the garbage can to clean the interior of the garbage can.

7. The garbage can cleaning system as set forth in claim 6, further comprising:

said brush member of said scrubbing assembly comprising a rod portion and a plurality of bristle portions, said rod portion being coupled to said platform assembly such that said rod portion extends upwardly from said platform assembly, said bristle portions being coupled to said rod portion such that said bristle portions radially extend from said rod portion, said bristle portions being adapted for brushing against the interior of the garbage can to clean debris from the interior of the garbage can.

8. The garbage can cleaning system as set forth in claim 7, further comprising:

each of said bristle portions of said brush member comprising a flexible material, said flexible material of said bristle portions being adapted for permitting said bristle portions to conform to a shape of the garbage can to provide the greatest amount of cleaning area.

9. The garbage can cleaning system as set forth in claim 6, further comprising:

said scrubbing assembly comprising a motor assembly, said motor assembly being operationally coupled between said brush member of said scrubbing assembly and said platform assembly, said motor assembly being for rotating said brush member such that said brush member is rotated in the interior of the garbage can to facilitate cleaning of the interior of the garbage can.

10. The garbage can cleaning system as set forth in claim 1, wherein said scrubbing assembly comprises a brush member rotatably mounted on said platform assembly and extending upwardly from the upper surface of said platform assembly for insertion into the interior of the garbage can when the garbage can is turn upside down and positioned over the brush member;

wherein said brush member comprises a rod portion and a plurality of bristle portions, said bristle portions being coupled to said rod portion such that said bristle portions radially extend from said rod portion, at least a portion of said plurality of bristle portions extending in a substantially hemispherical arrangement from an end of said rod portion.

11. The garbage can cleaning system as set forth in claim 1, wherein said at least one nozzle is positioned such that fluid exiting said at least one nozzle is directed toward said at least one scrubbing assembly.

12. A garbage can cleaning system for cleaning the interior of a garbage can, the garbage can cleaning system comprising:

a platform assembly being adapted for being positioned on a vehicle, said platform assembly being adapted for storing fluid to be used for cleaning the garbage can, said platform assembly having an upper surface on which the garbage can to be cleaned is rested during cleaning;

at least one fluid distribution assembly being coupled to said platform assembly, said fluid distribution assembly being adapted for being in fluid communication with the fluid stored by said platform assembly such that said fluid distribution assembly is for spraying the fluid into the garbage can to facilitate cleaning of the garbage can;

at least one scrubbing assembly being coupled to said platform assembly, said scrubbing assembly being adapted for scrubbing an interior of the garbage can to remove debris from the interior of the garbage can;

said platform assembly comprising a perimeter wall, said perimeter wall defining an interior space of said platform assembly, said interior space of said platform assembly being adapted for receiving the fluid draining from the garbage can such that said perimeter wall of said platform assembly is adapted for containing the used fluid in said interior space of said platform assembly when said fluid distribution assembly sprays fluid into the garbage can;

said platform assembly comprising a drainage aperture extending through said perimeter wall of said platform assembly, said drainage aperture being in fluid communication with said interior space of said platform assembly, said drainage aperture being adapted for permitting fluid collected in said interior space of said platform assembly to be selectively drained out of said interior space of said platform assembly;

said platform assembly comprising a tank member, said tank member being coupled to said perimeter wall of said platform assembly, said tank member being adapted for storing fluid to be used for cleaning the garbage can, said tank member being in fluid communication with said fluid distribution assembly such that said fluid distribution assembly is adapted for spraying fluid from said tank member into the garbage can;

said fluid distribution assembly comprising a pair of nozzle members, said nozzle members being coupled to said platform assembly such that said nozzle members is positioned proximate said scrubbing assembly, said nozzle members being in fluid communication with said tank member of said platform assembly such that said nozzle members spray the fluid from said tank member into the garbage can when said scrubbing assembly is scrubbing the interior of the garbage can, said nozzle members being positioned substantially orthogonal to said platform assembly to direct fluid towards a bottom of the garbage can when said scrubbing assembly is positioned in the interior of the garbage can;

said nozzle members being positioned on said platform assembly such that fluid exits said at least one nozzle substantially at the upper surface of said platform assembly;

said at least one nozzle being oriented on said platform assembly such that fluid exiting said at least one nozzle member flows in a substantially orthogonal direction with respect to the upper surface of said platform assembly to direct fluid upwardly towards a bottom of the garbage can when said scrubbing assembly is positioned in the interior of the garbage can;

said at least one nozzle being positioned such that fluid exiting said at least one nozzle is directed toward said at least one scrubbing assembly;

said fluid distribution assembly comprising a pump assembly, said pump assembly being coupled to said platform assembly such that said pump assembly is in fluid communication with said task member of said platform assembly, said pump assembly being operationally coupled to said nozzle member such that said pump assembly is for pressurizing the fluid from said tank member and transferring the fluid to said nozzle member to be sprayed into the garbage can;

said scrubbing assembly comprising a brush member, said brush member being coupled to said platform assembly such that said brush member extends upwardly from said platform assembly, said brush member being adapted for being inserted into the interior of the garbage can when the garbage can is turn upside down and positioned over the brush member to allow debris and fluid from the interior to drain onto the platform assembly, said brush member being adapted for brushing against the interior of the garbage can to clean the interior of the garbage can;

said brush member of said scrubbing assembly comprising a rod portion and a plurality of bristle portions, said rod portion being coupled to said platform assembly such that said rod portion extends upwardly from said platform assembly, said bristle portions being coupled to said rod portion such that said bristle portions radially extend from said rod portion, said bristle portions being adapted for brushing against the interior of the garbage can to clean debris from the interior of the garbage can;

at least a portion of said plurality of bristle portions extending in a substantially hemispherical arrangement from an end of said rod portion;

each of said bristle portions of said brush member comprising a flexible material, said flexible material of said bristle portions being adapted for permitting said bristle portions to conform to a shape of the garbage can to provide the greatest amount of cleaning area; and said scrubbing assembly comprising a motor assembly, said motor assembly being operationally coupled between said brush member of said scrubbing assembly and said platform assembly, said motor assembly being for rotating said brush member such that said brush member is rotated in the interior of the garbage can to facilitate cleaning of the interior of the garbage can.

* * * * *